United States Patent [19]

Lindqvist

[11] 4,407,035

[45] Oct. 4, 1983

[54] MODULARIZED PNEUMATIC TRACTOR WITH DEBRIS LIQUEFIER

[76] Inventor: Albert Lindqvist, P.O. Box 2606, Christiansted, St. Croix, V.I. 00820

[21] Appl. No.: 373,412

[22] Filed: Apr. 30, 1982

[51] Int. Cl.[3] ..... B08B 9/08

[52] U.S. Cl. ..... 15/3; 15/93 R; 414/140; 414/304

[58] Field of Search ..... 15/3, 340, 93; 37/202; 414/140, 304

[56] References Cited

U.S. PATENT DOCUMENTS 178,172 5/1876 Mabbs ..... 37/202

947,121 1/1910 McLain ..... 37/202

3,395,467 8/1968 Allen et al. ..... 37/202 X

*Primary Examiner*—Edward L. Roberts

*Attorney, Agent, or Firm*—Bruce L. Birchard

[57] ABSTRACT

By providing a tractor with easily disassembled and assembled modular construction, with pneumatic drive and with high-pressure hydraulic means and vacuum means for, respectively, liquefying collected debris and exhausting it from the work area, an unique machine is provided which is particularly adapted for introduction into and use in cleaning areas, such as inside oil storage tanks, where flammable fumes exist and access openings into the work area are limited in size.

10 Claims, 6 Drawing Figures

MODULARIZED PNEUMATIC TRACTOR WITH DEBRIS LIQUEFIER

BACKGROUND OF THE INVENTION

1. Field of the Invention

This invention relates to work vehicles, and more particularly, to work vehicles for use in areas having limited access and presenting hazardous environments.

2. Prior Art

One of the problems with the super-tankers of today is that, after the oil is pumped out, there remains a layer of intermixed oil, sand and sludge which must be removed before the tanker returns to the oil source, because that residue is dead weight and causes needless consumption of fuel. That same problem is faced in oil storage tanks. Access to the hold of a tanker or the inside of a storage tank is through openings of limited diameter, usually about 30 inches. As a result, the cleaning of the hold or storage tank, has been done, traditionally, by manual labor. That process is slow and hazardous. Further, the fumes in the hold of the tanker or in the storage tank may be flammable, making the use of gasoline driven devices dangerous. Any exhaust from such devices may also pose a threat in this environment.

Further, after the debris in the bottom of the tanker or storage tank has been plowed into one or more piles, it is difficult, costly and time consuming to remove the solid or semisolid sludge from the tanker or tank, using conventional techniques.

Therefore, it is a general object of the present invention to overcome the disadvantages of prior art devices.

It is a further object of this invention to provide a modularized work vehicle which can be disassembled quickly, passed through an access opening of limited diameter, and easily reassembled in the work area.

It is a still further object of this invention to provide a work vehicle which can be transported into a work area through an access opening of small size and reassembled and operated with ease in a hostile environment.

It is an additional object of this invention to provide a work vehicle which will make easy the removal of debris from an area being cleaned.

SUMMARY OF THE INVENTION

A tractor-like machine is modular, i.e., it can be easily assembled and disassembled into modules that can pass through access openings of limited size. At the same time the machine is driven by an air motor rather than an internal combustion engine so that it may be used in an inflammable vapor environment, such as an oil storage tank. The scoop portion of the machine is provided with one or more high-pressure hydraulic jets which liquefy debris collected in the scoop and permit the rapid and safe removal therefrom by pump or vacuum means. The described machine is unique and ideally suited for removal of sludge and sand from oil tankers and oil storage tanks.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

DETAILED DESCRIPTION OF THE PREFERRED EMBODIMENT

Figure 1:
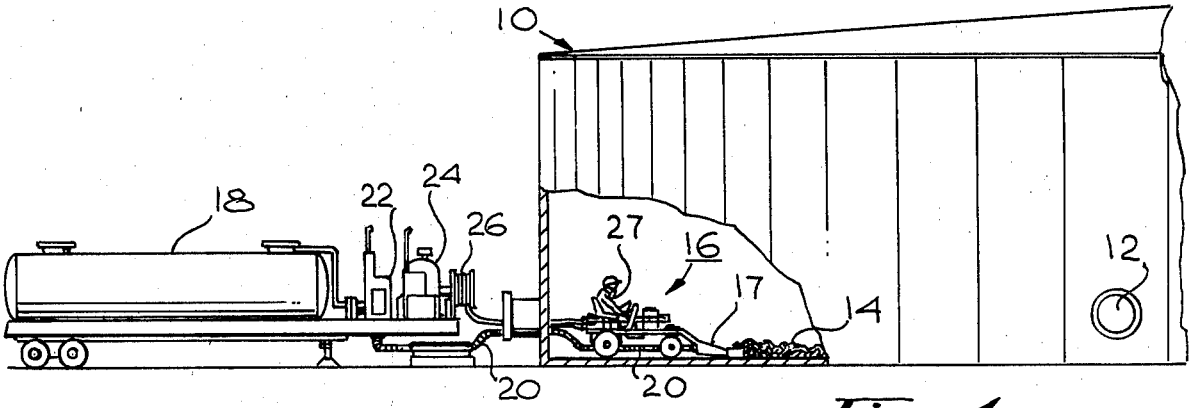
FIG. 1 is a schematic drawing of a system utilizing the present invention.

In FIG. 1, storage tank or tanker 10 has an access opening 12 in a lower extremity thereof. This access opening is, normally, about 30" in diameter. After the oil has been pumped out of tank or tanker 10, there remains a mixture 14 of oil, sand and tar, generally referred to as "sludge" in the bottom of tank or tanker 10. The length or diameter of the tanker or tank may be 284 feet. The tractor 16 or this invention is, module-by-module, brought to the inside of tanker 10 through opening 12 and is used by an operator to scrape sludge. Sludge accumulated in scoop 17 is liquefied in a manner described in connection with FIG. 4. After liquefaction the sludge is pumped into disposal truck 18 by way of vacuum hose 20 and compressor pump 22 which is driven by motor 24. Compressed air may be provided from compressor 22 by way of hose 26 to tractor 16, and, at reduced pressure, to mask 27 on the driver of tractor 16.

Figure 2:
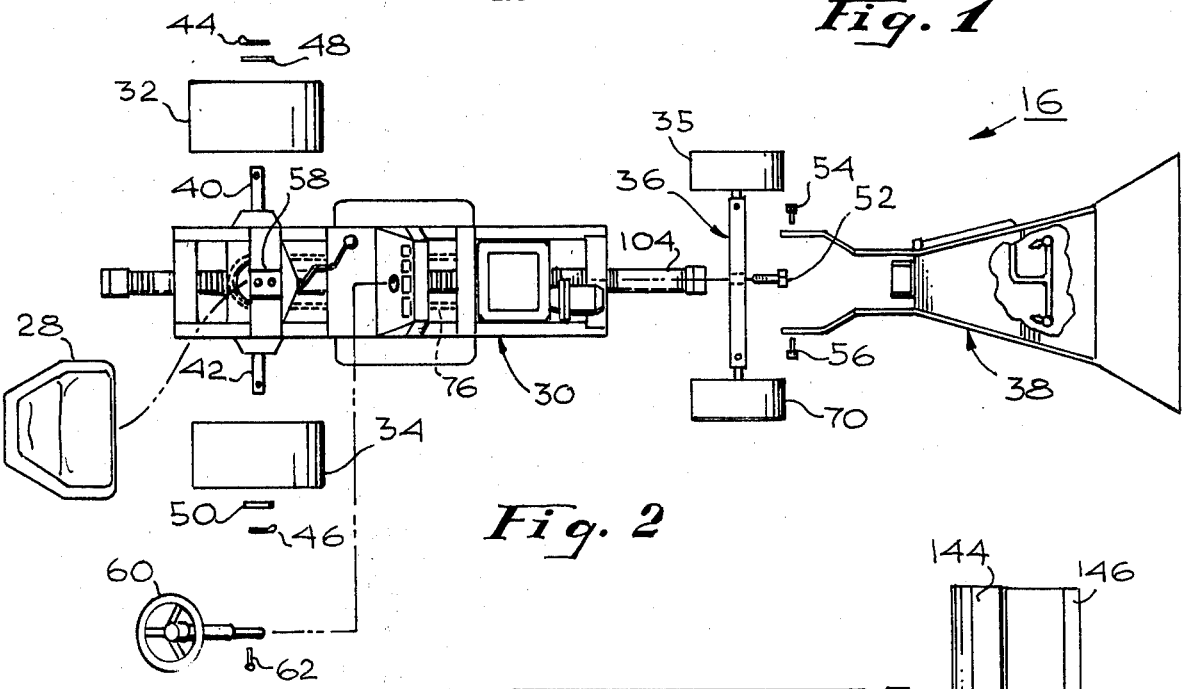
FIG. 2 is a schematic, exploded view of the basic modules of the present invention.

In FIG. 2, tractor 16 comprises six modules, seat 28, main chassis 30, left back wheel 32, right back wheel 34, front wheel assembly 36, including left front wheel 35 and right front wheel 70, and scoop assembly 38. Right and left back wheels 32 and 34 are held on respective axles 40, 42 by cotter pins 44, 46, respectively. Washers 48, 50 may also be provided. Front wheel assembly 36 is secured to main chassis 30 by quick-release bolt 52. Scoop assembly 38 is secured to main chassis 30 by bolts 54, 56. Seat 28 is removably bolted to bracket 58 by bolts, not shown. Steering wheel 60 is secured to the steering linkage, not shown, by pin 62. When all of the modules are separated, they may be passed easily through opening 12.

Figure 3:
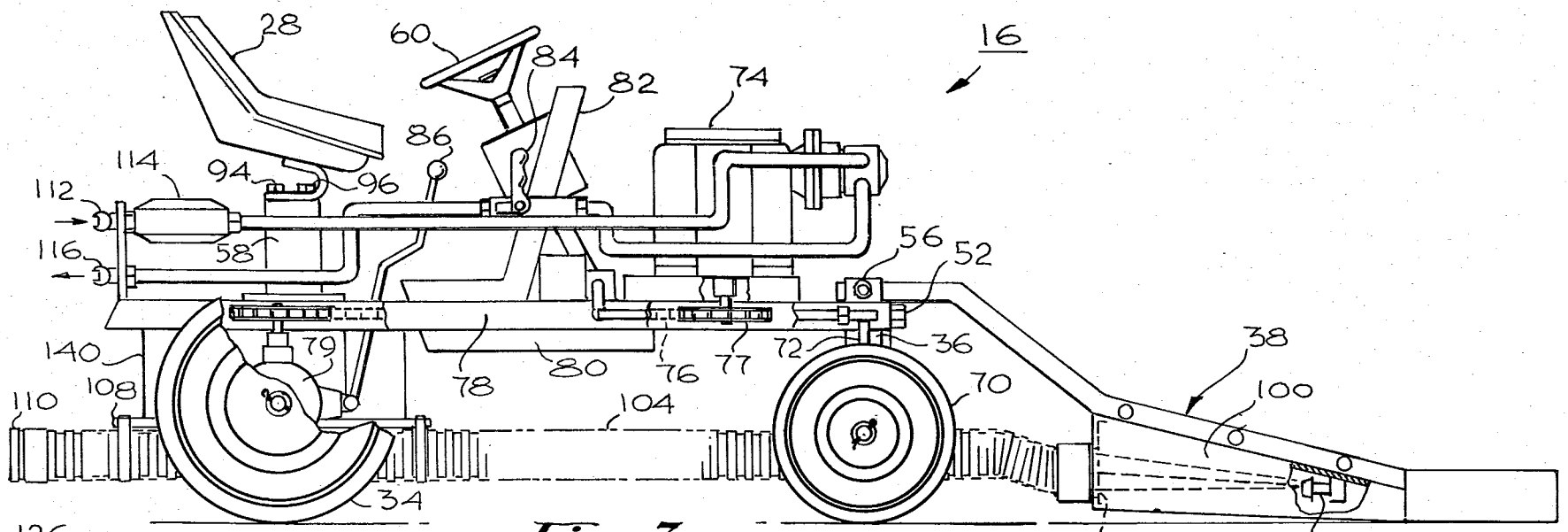
FIG. 3 is an elevational view (partially cut away) of a tractor according to the present invention.

In FIG. 3, tractor 16 has right wheel 34 (which may carry a pneumatic tire), a right front wheel 70 carried in a front wheel assembly 36 including a steering axle 72, and an air motor 74 which drives chain 76 through sprocket 77 and ultimately drives wheel 34 through transmission 79. Frame 78 is the main supporting element for the combination of elements which makes up tractor 16. For example, front wheel assembly 36 is secured to frame 78 by means of quick release bolt 52. A foot rest 80 is suspended from frame 78. A control panel 82 carrying various operating controls and indicators is supported from frame 78 for viewing and easy access by the operator of tractor 16. Control handle 87 is provided for controlling the speed of tractor 16. Gear shift handle 86 controls the power level transmitted to the wheels of tractor 16.

Steering of tractor 16 is accomplished by means of steering wheel 60 coupled through linkage 92 too front wheel assembly 36. Seat 28 is secured to bracket 58 by bolts 94, 96.

Scoop 100 in scoop assembly 38 may be made of aluminum to facilitate its handling in assembling and dis-assembling the tractor 16. Scoop assembly 38 is secured to frame 78 by bolts 56 and 54 (the latter being seen in FIGS. 2 and 4.) Scoop 100 includes a pair of hydraulic jets, one of which, jet 102, can be seen in FIG. 3. The function of this jet will be described more fully in connection with FIG. 4, but, generally, it emits a high-pressure stream of oil which liquefies any sludge collected in scoop 100. Stainless steel, flexible, air-tight tube 104, which is connected to an opening 106 in scoop 100, permits exhaustion of liquefied sludge through tube 20 (FIG. 1) to disposal truck 18. Tube clamp 108 supports tube 104 from frame 78. Connector 110 permits easy connection to a cooperating connector on tube 20 (FIG. 1). Connector 112 permits the introduction of air to drive air motor 74. Lubricating oil for air motor 74 is provided from reservoir 114. Exhaust air is taken from connector 116.

Figure 4:
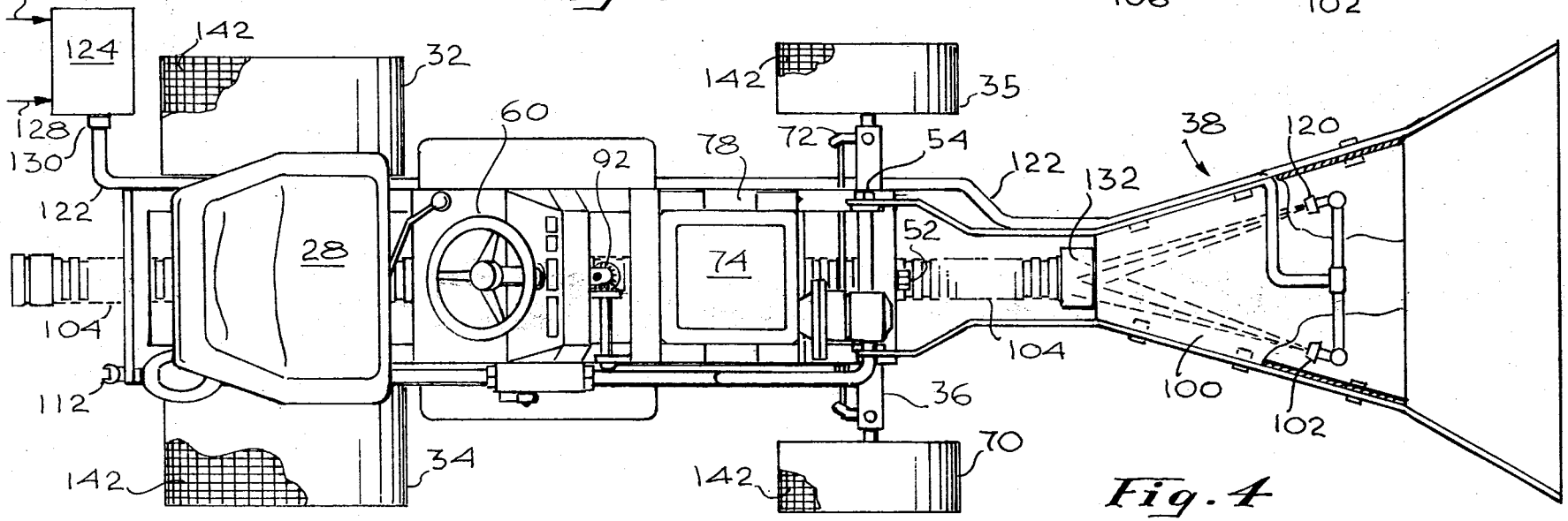
FIG. 4 is a plan view, partically schematic and partially cut away, of the tractor of FIG. 3.

Turning to FIG. 4, the same identifying numbers are assigned to the same elements. Particular attention should be paid to the action of jets 102 and 120. Oil, for example, No. 2 diesel oil, at high pressure is introduced into tube 122 from tube blaster 124. The term "tube blaster" is one used in the trade for a pressure amplifier which takes compressed air at input 126 from compressor 22 or a companion compressor (not shown) driven by diesel engine 24 and oil at input 128 from a diesel oil source, not shown, and exhausts diesel oil at high pressure through port 130. The oil travels through jets 120 and 102, and streams from the two jets converge in region 132 at pressures of 4000 p.s.i. Because the pressure in flexible tube 104 in the region of mouth 106 in scoop 100 is below atmospheric pressure, sludge is urged into tube 104 from scoop 100. As it moves into the region of mouth 106, it passes into the high pressure hydraulic jet region 132 and is liquefied for easy extraction through tube 104. Tube 104 is supported from frame 78 by means of bracket 140 (FIG. 3).

It is desirable and necessary to reduce static discharge in the tank or tanker so as to avoid igniting the ambient oil fumes in the tank or tanker 10. To that end the wheels 32, 34, 35 and 70 may have an aluminum mesh cover 142 over each. Such cover carries all static electricity to ground through a conductive path, rather than by sparking. Such aluminum (or other metal) mesh also improves traction in the oily environment.

Figure 5:
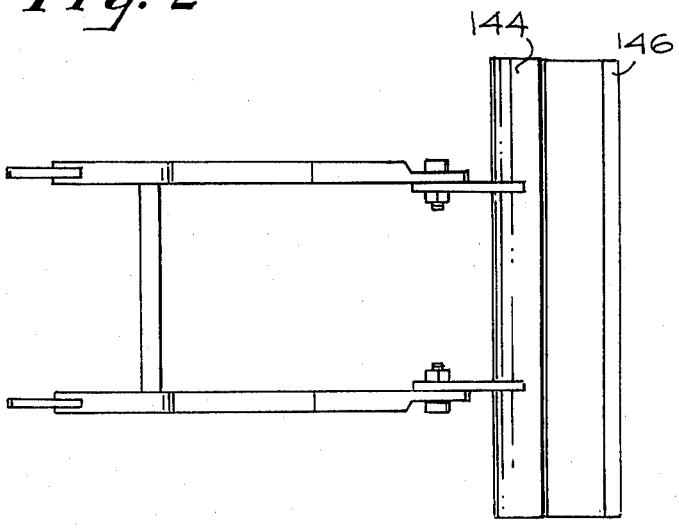
FIG. 5 is a plan view of an alternate implement for use with the tractor of FIG. 3.
Figure 6:
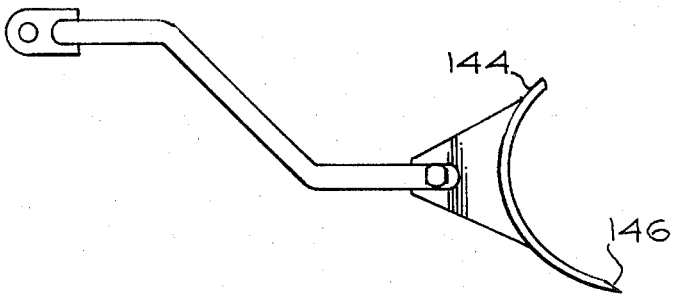
FIG. 6 is an elevational view of the implement of FIG. 5.

After tank or tanker 10 is rid of the major sludge deposits, scoop 100 may be replaced by plow 144 of FIGS. 5 and 6. Plow 144 carries a squegee portion 146, which may be of rubber, for the ultimate in cleaning of tank 10.

While particular embodiments have been shown and described, it will be apparent to those skilled in the art that variations therein and modifications thereof may be made without departing from the spirit and scope of this invention.

I claim:

1. A modularized tractor including:

a main chassis;

seat, left back wheel, right back wheel, front wheel assembly, and scoop assembly modules;

means for removably connecting said modules to said main chassis;

a pneumatic motor carried by said main chassis;

pneumatic tube means coupled to said motor and adapted for coupling to a source of compressed air;

means coupling said pneumatic motor to said left and right back wheels for moving said tractor;

means carried by said main chassis and coupled to said front wheel assembly for steering such assembly; said scoop assembly comprising a scoop which is enclosed except for a sludge inlet opening and a liquefied sludge outlet opening opposed to said inlet opening;

at least one jet orifice supported inside said scoop and directed at said sludge outlet opening;

an exhaust tube having first and second ends, said first end being coupled across said outlet opening in said scoop to receive the outflow from said scoop, said second end being adapted for coupling to an exhaust pump; and, tube means coupled to said at least one jet orifice and adapted for coupling to a source of hydraulic fluid at high pressure.

2. Apparatus according to claim 1 in which the number of jet orifices is two.

3. Apparatus according to claim 1 which includes, in addition, control means interposed in said pneumatic tube means for controlling the speed of said pneumatic motor.

4. Apparatus according to claim 1 which includes, in addition, transmission mens interposed in said means for coupling said pneumatic motor to said left and right back wheels.

5. Apparatus according to claim 1 in which said means for coupling said pneumatic motor to said left and right back wheels includes a chain drive.

6. Apparatus according to claim 1 which includes, in addition, tube blaster means coupled to said tube means for supplying said hydraulic fluid.

7. Apparatus according to claim 6 in which said tube blaster means provides diesel oil at high pressure as said hydraulic fluid.

8. Apparatus according to claim 1 including, in addition, liquefied sludge disposal means coupled to said second end of said exhaust tube.

9. Apparatus according to claim 1 which includes, in addition, an oil reservoir interposed in said pneumatic tube means coupled to said motor and adapted for coupling to a source of compressed air.

10. Apparatus according to claim 1 which includes, in addition, a source of compressed air coupled to said pneumatic tube means.

* * * * *